United States Patent [19]

Mauch

[11] Patent Number: 4,860,835

[45] Date of Patent: Aug. 29, 1989

[54] DIESEL TYPE PILE-DRIVER

[75] Inventor: Magnus Mauch, Göppingen, Fed. Rep. of Germany

[73] Assignee: Gebruder Lindenmeyer GmbH, Fed. Rep. of Germany

[21] Appl. No.: 230,979

[22] Filed: Aug. 11, 1988

Related U.S. Application Data

[63] Continuation of Ser. No. 943,036, Dec. 18, 1986, abandoned.

[30] Foreign Application Priority Data

Dec. 23, 1985 [DE] Fed. Rep. of Germany ..... 3545880

[51] Int. Cl.[4] ..... B25D 17/06

[52] U.S. Cl. ..... 173/133; 173/128

[58] Field of Search ..... 173/128, 133, 171

[56] References Cited

U.S. PATENT DOCUMENTS

| | | | |
|---|---|---|---|
| 2,792,816 | 5/1957 | Oyer | 173/128 |
| 4,497,376 | 2/1985 | Kurylko | 173/1 |
| 4,523,647 | 6/1985 | Last | 173/133 |

FOREIGN PATENT DOCUMENTS

| | | |
|---|---|---|
| 0059798 | 9/1982 | European Pat. Off. . |
| 0850725 | 9/1952 | Fed. Rep. of Germany . |
| 0901758 | 1/1954 | Fed. Rep. of Germany . |
| 1253179 | 10/1967 | Fed. Rep. of Germany . |
| 2753806 | 6/1978 | Fed. Rep. of Germany . |
| 2072760 | 8/1971 | France . |
| 2157292 | 5/1973 | France . |

*Primary Examiner*—Frank T. Yost
*Assistant Examiner*—James L. Wolfe
*Attorney, Agent, or Firm*—Fred Philpitt

[57] ABSTRACT

A diesel type pile-driver has a cup-shaped monkey (36) accommodated in a sliding fit on the external face of the lower end of the cylinder.

21 Claims, 3 Drawing Sheets

DIESEL TYPE PILE-DRIVER

This is a continuation of application Ser. No. 943,036, filed Dec. 18, 1986 now abandoned and the benefits of 35 USC 120 are claimed relative to it.

GENERAL DESCRIPTION

The invention relates to a diesel type pile-driver in accordance with the opening portion of claim 1.

A pile-driver of this type is disclosed in German Patent No. 20 40 924. There the monkey incorporates a cylindrical shaft section which is accommodated in sliding play in the bottom end of the cylinder. The top end face of the shaft section, along with the cylinder wall and the ram accommodated in the cylinder, delimits the working area of the pile driver.

If the monkey is to be prevented from overturning it is necessary for its shaft section to project far into the cylinder. For given maximum axial dimensions of the working area and given axial dimensions of the ram the cylinder therefore needs to be relatively generously proportioned. If to obtain a pile-driver with compact axial dimensions the axial dimensions of the monkey shaft section are made small, this may mean that under the eccentric loads which are unavoidable under uneven operating conditions the monkey will overturn and exert great forces on the inner face of the cylinder. For this reason a separate guide sleeve for the monkey is in practice inserted in the bottom end of the cylinder. This results in high manufacturing costs.

The present invention aims to develop a diesel pile-driver of the type indicated in the opening portion of claim 1 such that the overall axial dimensions of the pile-driver are reduced while ensuring that the monkey is safe from overturning.

This problem is solved under the invention by a diesel type pile-driver as recited in claim 1.

In the diesel type pile-driver of the invention the outer face of the cylinder bottom is used to guide the monkey on the lower end of the cylinder and cooperates with a cylindrical peripheral wall of the monkey, which is cup-shaped. The monkey guideway thus overlaps in axial direction with the working area of the pile-driver and coaxially encloses it. In this manner the overall axial dimensions of the pile-driver are reduced by the axial dimensions of the monkey guideway.

In the diesel type pile-driver of the invention the fixed cylindrical monkey guide surfaces are on the outer face of the cylinder. From the aspect of special treatment for high wear resistance they therefore offer particular ease of access, and can readily be specially hardened, face-hardened, refined (e.g. chromium-plated) and finished. This also means that after any wear they can easily be reprocessed. There is no need for the separate monkey guide sleeve which is necessary in the case of the known diesel pile-driver and whose inside surface has to be an exact continuation of the ram guide surface, so that the cost of manufacturing the great cylinder, which often weighs several tons, is lowered appreciably. Although in the pile-driver of the invention internal guide faces (the inner surface of the monkey's peripheral wall) do also need to be finished, by comparison with the cylinder these are on a small and hence more easily finished hammer unit (monkey).

As already outlined above, the diesel type pile-driver of this invention can be made axially shorter while meeting the same requirements in connection with the monkey guideway. This is an advantage if the pile-driver is to be used in cramped conditions (e.g. under a bridge or in a building with existing ceilings). Conversely, the same overall axial dimensions as in conventional diesel pile-drivers may be maintained while increasing the maximum permissible stroke of the monkey and reducing the possibility that the latter might overturn. Increasing the monkey's stroke is an important improvement when driving takes place on a soft bed, where the pile being driven encounters only little resistance initially. In the case of known diesel pile-drivers special precautions have to be taken to limit the striking force by using a short monkey path, and on occasion it is necessary to use a small rammer first.

Since the monkey in the pile-driver of this invention is cup-shaped this also prevents any lubricant from escaping from the cylinder. Any lubricant that runs down the guide surfaces collects on the floor of the cup, and when the ram strikes it becomes atomized and burned along with the fuel.

A further advantage of the diesel pile-driver of the invention is the fact that the distance between the top end of the monkey which is struck by the ram and the bottom end of the monkey which acts on the pile or similar object being driven, or on a helmet placed thereon, can be made much smaller than in the case of the known diesel type pile-driver. There the blow places the whole volume of the monkey shaft section in the bottom end of the cylinder under stress. Since under the very great impact loadings involved, even materials like steel which in normal circumstances would be regarded as rigid are elastic, the workpiece being driven can thus be subjected to harder blows using the pile-driver of the invention.

The peripheral wall of the cup-shaped monkey which is on the outside in the pile-driver of the invention also represents an additional cooling surface for the monkey, so the latter becomes less heated during operation. As stated in claim 15, the pile-driver of the invention may, if desired, be equipped with cooling fins on the peripheral wall of the monkey to enhance cooling still further.

Advantageous refinements of the invention are given in subclaims.

The embodiment of the invention according to claim 2 is advantageous from the point of view of providing efficient sealing of the working area of the pile-driver while ensuring that the amount of sliding friction between the monkey and the cylinder is low.

In a diesel pile-driver of the type indicated in claim 4, the working area has no parts lying radially outside the cylinder wall, where gas flushing would be less effective.

The embodiment of the invention according to claim 5 ensures that the monkey is less vulnerable to overbalancing, while providing low sliding friction between the axially enlarged monkey and the outer surface of the cylinder. Claim 6 also presents a refinement of the invention that reduces the amount of friction.

The measure recited in claim 7 means on the one hand that the monkey is securely held on the end of the cylinder, thereby enabling the pile-driver to be transferred as one unit by a lifting jack. Additionally it provides a stop device which compulsorily delimits the path of the monkey in both directions of travel with little constructional outlay: the packing collar and the guide collar also act as stop shoulders.

Thanks to the embodiment in claim 8, serious impact shocks at the ends of the monkey stroke are avoided and hence the packing collar and guide collar are not subjected to impermissibly high impact stresses.

The advantage offered by the embodiment in claim 9 is that it is easy to mount the monkey on the end of the cylinder. In a pile-driver as stated in claim 9 it is a simple matter to inspect the cooperating running faces of the cylinder and the monkey even on site, the piston rings in the outer face of the cylinder end can readily be renewed as required, and even the annular damping plates are simple to replace.

The embodiment of the invention in claim 10 allows the monkey to be locked against rotation on the end of the cylinder. This is not only an advantage in that it prevents the monkey from wandering unchecked in an angular direction, but the angular spaces that are left between the guide brackets can be used to attach auxiliary equipment on the outer face of the cylinder, as indicated in claim 14, or an axial lubricant feed pipe can be used to supply lubricant to the slide face between the packing collar and the monkey, said feed pipe being positioned on the outer face of the cylinder as indicated in claim 13.

The embodiment of the invention in claim 16 enables the working area of the diesel type pile-driver to be essentially located inside the cylinder, but it is not necessary to make the outer face of the packing collar exactly coaxial with the inside surface of the cylinder.

Even in a diesel type pile-driver in accordance with claim 17 the monkey guideway does not increase the overall axial length of the pile-driver. Under claim 17 the bottommost part of the cylinder bearing surface serves as a guide face for the peripheral wall of the cup-shaped monkey, the ram not brushing said bearing surface since the bottommost part of the ram has a reduced diameter. In terms of fuel combustion and transmission of the impact from the ram to the monkey, the operation of a diesel pile-driver according to claim 17 is the same as one according to claim 1. The overall axial area they require is also identical. The fact that a running face exhibiting somewhat lesser axial proportions is available to guide the ram is acceptable in practice in many application surfaces, since the ram in any case has large axial dimensions, which means that its stability against overturning is ensured by running faces with a large axial gap even if an unguided ram end section of reduced diameter is provided.

The invention is explained in more detail below with the aid of working examples and with reference to the drawings, in which.

Figure 1:
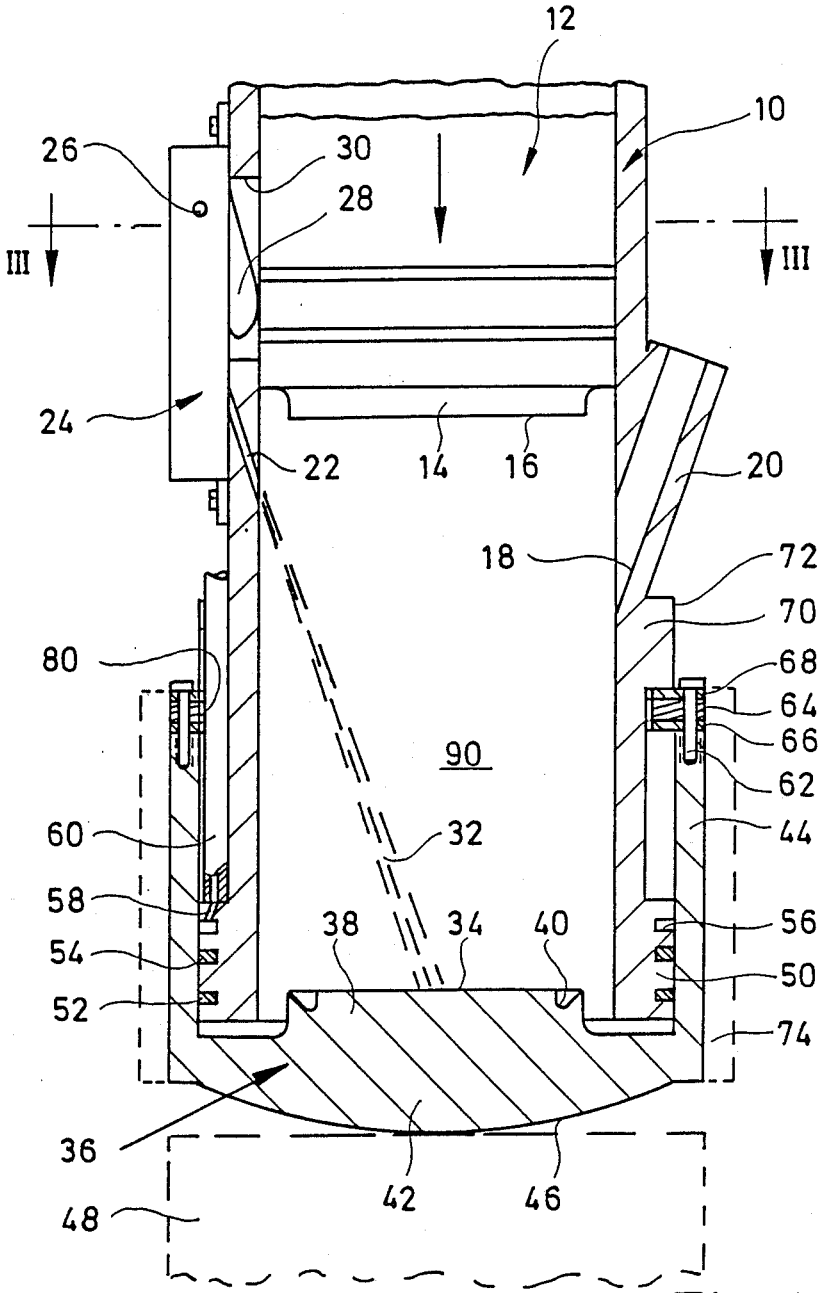
FIG. 1 shows an axial section through the bottom end of a diesel type pile-driver.

The diesel type pile-driver illustrated in FIG. 1 has a cylinder 10 which is open at both ends and in which travels a ram 12.

The ram 12 has a lower central projection 14 which exhibits a circular flat end face 16.

A groove 18 is provided in the wall of the cylinder 10 and communicates with a connection 20. The groove 18 serves to supply fresh air to the interior of the cylinder and carry away the products of combustion therefrom.

Opposing the groove 18 an injector duct 22 is provided in the wall of the cylinder. The injector duct 22 is supplied with pressurized fuel from an injection pump 24, which is only represented schematically. The injection pump 24 is mechanically operated by the falling ram 12, and for that purpose it exhibits an operating lever 28 which can be pivoted about a pin 26. The operating lever is spring-biased radially inwards and is able to project through an aperture 30 in the cylinder wall into the path of the ram 12. In the drawing the ram 12 is illustrated at a point of downward motion when it has just pushed the operating lever 28 radially outwards into the aperture 30, so that the injection pump 24 has produced a jet of fuel 32.

The jet of fuel 32 hits the circular top end face 34 of a monkey designated overall by 36. Just like the end face 16, end face 34 is perpendicular to the cylinder axis and has the same diameter as it has. It is defined by an axially short projection 38 of the monkey 36 into the rim of which a channel 40 is recessed. The latter serves to trap fuel escaping radially across the end face 34.

The projection 38 is formed onto the top surface of a floor 42, the rim of which bears a cylindrical peripheral wall 44 of the monkey 36. Thus overall the monkey 36 has the shape of a cylindrical cup. As can be seen from FIG. 1, the bottom surface 46 of the floor 42 is in the shape of a spherical cap, so that axial misalignments between the axis of the diesel pile-driver and the axis of a driven object 48 only schematically represented in FIG. 1 (post, pipe or similar) are absorbed.

A radially proud packing collar 50 is formed onto the bottom end of the cylinder 10 and its bottom face coincides with the bottom face of the cylinder. Into the outer surface of the packing collar 50 are inserted two axially spaced piston rings 52, 54, which are in sliding contact with the inner face of the peripheral wall 44. In addition a radially open lubrication groove 56 is cut into the top end of the outer face of the packing collar 50 and communicates via a delivery bore 58 leading to the top circular face of the packing collar 50 with a feed pipe 60. The feed pipe 60 is placed on the outer face of the cylinder 10 to run in axial direction and extends through the annular space between the outside of the cylinder and the inside surface of the peripheral wall 44. The second end of the feed pipe 60, not shown in the drawing, is connected to a lubrication pump (not illustrated), which is actuated by the ram 12 as it falls, in similar manner to the injection pump 24.

A stack of annular plates is fixed by screws 62 at the top end of the peripheral wall 44 and comprises an annular stop plate 64, a subjacent annular damping plate 66 and a superjacent annular damping plate 68. The inner rim of these plates lies a short distance from the outer face of the cylinder 10.

The plate stack just mentioned grips radially under the lower annular face of a guide collar 70 formed onto the cylinder 10 in the vicinity of the connection 20 and defines a cylindrical guide surface 72, which forms a continuation of the cylindrical outer face of the packing collar 50. By virtue of this geometrical arrangement the aforementioned stack of annular plates at the same time overlaps the annular top end of the packing collar 50 to produce overall a stop device which defines both limit positions of the monkey 36. Because the damping plates 66, 68 cushion the movement, impermissibly high impact stresses on the packing collar 50 and guide collar 70 are obviated.

As indicated by the broken line in FIG. 1, a plurality of cooling fins 74 may be formed onto the external surface of the peripheral wall 44 in axial distribution along the periphery.

Figure 2:
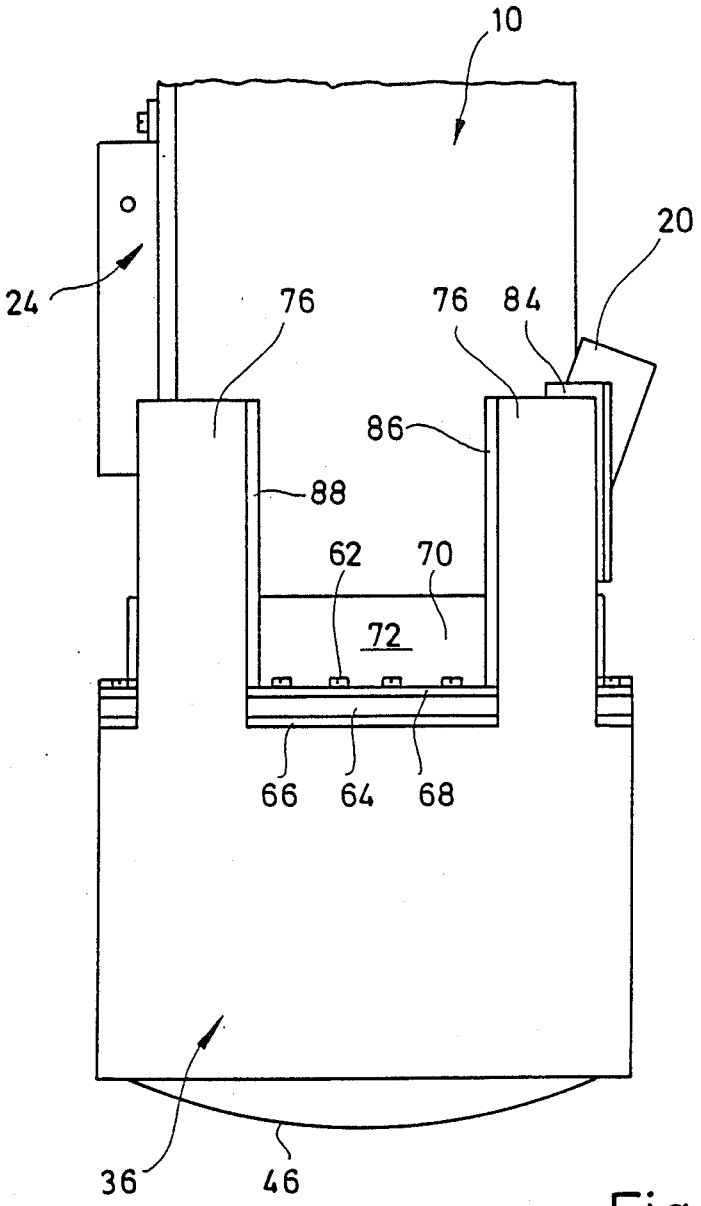
FIG. 2 shows a lateral view of the bottom end of the pile-driver.
Figure 3:
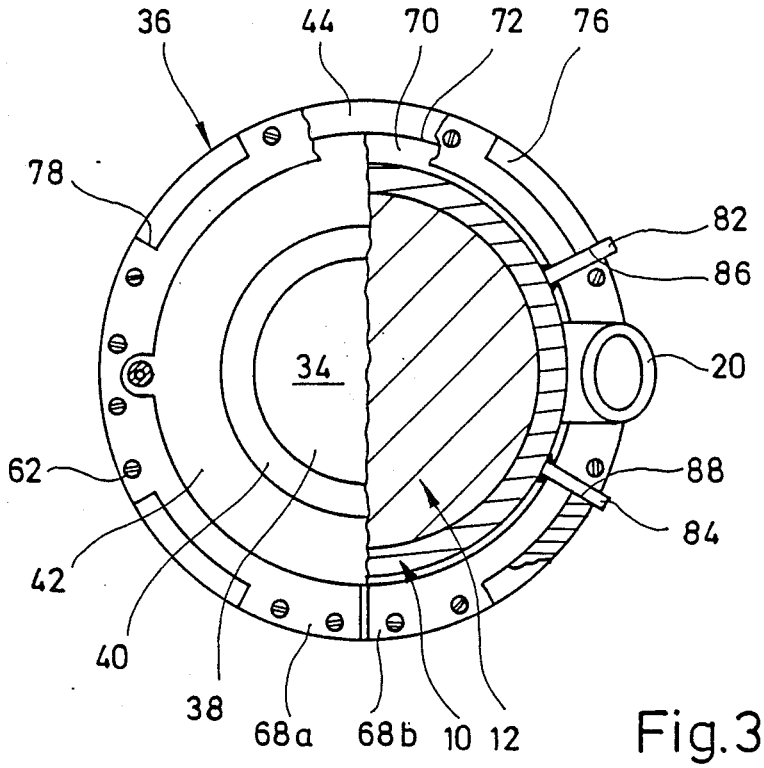
FIG. 3 is a section through the diesel type pile-driver shown in FIG. 1 along line III—III therein, the cylinder and ram of the driver having been omitted in the left-hand portion of the cutaway to give a better picture of details of the monkey below them.

As FIGS. 2 and 3 make clear, four guide brackets 76 are formed onto the top end of the peripheral wall 44 and spaced at 90° from each other, their curvature and thickness matching that of the peripheral wall 44. The guide brackets 76 pass through complementary rim recesses 78 in the stop plate 64 and damping plates 66, 68. As can be seen in FIG. 3, the stack of plates additionally exhibits an inner rim recess 80, through which the feed pipe 60 freely passes. FIG. 3 also shows that the stop plate 64 and damping plates 66, 68 consist in each case of two semi-circular parts, which for the top damping plate are designated by 68*a* and 68*b*, respectively.

In addition, two axial guide fins 82, 84 are welded onto the outer surface of the cylinder 10 at an angular distance from each other in such a way that they cooperate in sliding play with non-equivalent lateral plane guide faces 86 and 88 of the guide bracket which in FIG. 3 respectively lies above and below connection 20, namely the narrow face, shown at the bottom of FIG. 3, of the guide bracket superjacent to connection 20 and the narrow face, shown at the top in FIG. 3, of the guide bracket subjacent there to connection 20. Each of these narrow faces lies in a plane that goes through the axis of the cylinder.

Together with the guide collar 70 the guide brackets 76 thus provide an axial guideway for the monkey 36 on the cylinder 10 in a given angled orientation. This special design of the guide device for the monkey 36 allows the monkey guideway to be generously proportioned axially without adversely affecting the choice of position for the connection 20 or injection pump 24. Still further ancilliary equipment may be accommodated in the free spaces remaining in angular direction between the guide brackets 76, e.g. a connection between the feed pipe 60 and the lubrication pump.

The operation of the diesel type pile-driver described above is as follows:

If the ram continues its movement from the position shown in FIG. 1, it passes the groove 18 and then forms a closed working area 90 together with the monkey 36 and the bottom end of the cylinder 10. The air trapped therein is greatly compressed when the ram moves down further and it heats up accordingly. The downward movement of the ram 12 ends when its plane end face 16 hits the plane end face 34 of the monkey 36. The resulting power of impact is passed on to the driven object 48, and—as can be seen in FIG. 1—transmission path in the monkey is very small (the thickness of floor 42). The striking energy from the ram 12 is thus transmitted very effectively to the object being driven 48. The overall low density of the monkey 36 also contributes to this effect.

When the ram 12 strikes the monkey 36 the fuel on the end face 34 at the same time becomes atomized, and the resulting mix of high-temperature air and fine fuel droplets explodes. This causes the ram 12 to shoot back up again, and once the groove 18 is exposed the combustion gases can flow away through the connection 20. As the ram 12 moves further upwards fresh air is sucked in via connection 20 and then, when the ram has translated its kinetic energy into potential energy and begins to fall back downwards, a new operating cycle commences.

It is clear from the foregoing description that in the diesel type pile-driver as outlined the working area 90 extends practically as far as the end face of the cylinder 10. No space in the axial direction is required for the guideway of the monkey 36. Instead the monkey guideway is provided radially outside the working area 90 and coaxial therewith. The guide brackets 76 ensure that the monkey 36 is very well protected from overturning through an axis perpendicular to the axis of the cylinder, and auxiliary assemblies and connection cables may be disposed in the spaces remaining between the guide brackets 76. The effective stroke of the guide device is great, and allows the pile-driver also to be used for driving objects into a soft substrate. Thanks to the guide brackets 76 the monkey anti-topple device is still excellent even when the monkey in FIG. 1 has been moved a long way downwards.

The foregoing working example may also be modified by the provision of a plurality of connections 20, each of which is arranged in a gap between guide brackets 76. It is also possible to employ only two or three guide brackets instead of four, or conversely to use a larger number of guide brackets.

In a further modification of the foregoing working example the piston rings 52, 54 may be mounted on the inside of the peripheral wall 44 of the monkey 36, rather than on the outside of the cylinder 10, thus making the outer face of the cylinder 10 run smoothly through to its end.

Figure 4:
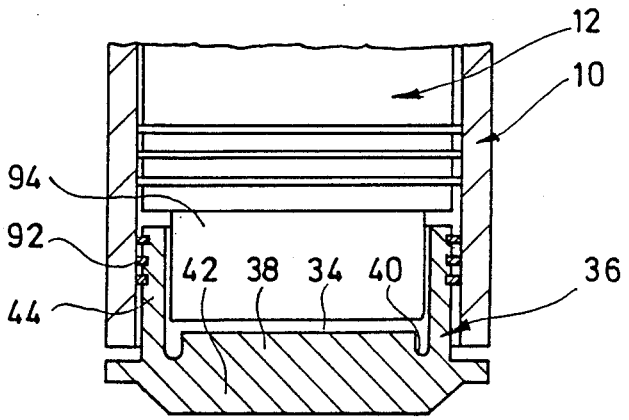
FIG. 4 is an axial section through the bottom end of a modified diesel type pile-driver.

FIG. 4 shows an axial section through the lower end of a modified diesel type pile-driver, where parts already elucidated above with reference to FIGS. 1 to 3 are again given the same reference numerals. These parts of the apparatus do not need to be described in detail again.

In the diesel type pile-driver of FIG. 4 the monkey 36 has a peripheral wall 44 which can be introduced into the bottom end of the cylinder 10 and is sealed by means of piston rings 92 against the cylinder bearing surface. The bottommost section of the cylinder bearing surface thus acts at the same time as a guide surface for the monkey 36.

The ram 12 has a lower end section 94 of reduced diameter which can be moved into the interior of the cup-shaped monkey 36, leaving a small radial clearance. As the drawing shows, the axial dimensions of the end section 94, that is to say the distance between its end face and the ram shoulder which delimits the end section 94, is somewhat larger than the effective axial dimensions of the interior of the cup-shaped monkey 36, that is the distance between the end face 34 of the floor 42 of the monkey 36 and the free end face of the peripheral wall 44.

Thus in the working example according to FIG. 4 the stroke of the ram 12 and the guideway for the monkey 36 likewise overlap. Since the ram 12 itself has very large axial dimensions, it is in practice of little significance if the end section 94 exhibiting reduced diameter is not itself in sliding contact with the bearing surface of the cylinder.

The driving cycle in the diesel pile-driver of FIG. 4 is the same as described above in detail for the working example according to FIGS. 1 to 3. In the working example shown in FIG. 4 the axial moment arm of the impact forces transmitted from the ram 12 to the monkey 36 is low, so that here too the overturning moments are small.

As can be seen in FIG. 4, the working example of a diesel type pile-driver illustrated there is distinguished by the fact that even in the radial direction it is particularly compact in construction. Nor does the bottom end of the pile-driver have any moving parts that are proud of the external profile of the cylinder 10.

I claim:

1. A diesel type pile-driver having a diesel cylinder 10 with an outer face and an open bottom end, a ram 12 accommodated in the diesel cylinder, a monkey 36 which slides around the bottom end of the diesel cylinder and seals off the latter to define a diesel working area thereabove, and means for supplying fresh air and fuel in phase with the movement of the ram to said diesel working area delimited by the ram, cylinder and monkey, and to take away the diesel combustion gases from the working area, characterized in that the monkey (36) is cup-shaped and runs with its cylindrical peripheral wall (44) in a sliding fit impervious to flowing agents on the outer face of the diesel cylinder (1), said diesel cylinder 10 having a radially projecting packing collar (50) in which at least one sliding seal ring (52, 54) is seated.

2. The diesel type pile-driver of claim 1 characterized in that the packing collar (50) bears several sliding seal rings (52, 54) lying axially behind one another.

3. The diesel type pile-driver of claim 1 characterized in that the packing collar (50) runs as far as said open bottom end of the diesel cylinder (10).

4. The diesel type pile-driver of claim 1 characterized in that a top section of the monkey (36) is provided with axial guide brackets (76), which run in a sliding fit on the outside of the diesel cylinder (10).

5. The diesel type pile-driver of claim 4 characterized in that the guide brackets (76) run in a sliding fit on a guide collar (70) borne on the outer face of the diesel cylinder (10).

6. The diesel type pile-driver of claim 5 characterized in that the guide brackets have base sections, the guide collar has a lowerface, the packing collar has an upper face, and at the base sections of the guide brackets (76) the monkey (36) is provided with an annular radially inwards projecting stop plate (64), which is able to abut at the lower face of the guide collar (70) and at the upper face of the packing collar (50).

7. The diesel type pile-driver of claim 6 characterized in that annular damping plates (66, 68) are mounted above said stop plate (64).

8. The diesel type pile-driver of claim 6 characterized in that the stop plate (64) and optionally also the annular damping plates (66, 68) are divided along at least one plane passing through the diesel cylinder axis and are detachably fixed (62) to the peripheral wall (44) of the monkey (36).

9. The diesel type pile-driver of claim 4 characterized by at least two essentially radial, longitudinally running guide means (82, 84) which cooperate with associated nonequivalent lateral faces (86, 88) of the guide brackets (76) in order to protect the monkey (36) from being swivelled on the diesel cylinder (10) in both directions.

10. The diesel type pile-driver of claim 9 characterized in that ancilliary devices such as a fuel injection pump (24), diesel combustion gas outlet (30), lubrication pump and connection cables are disposed on the outer face of the diesel cylinder (10) between the guide brackets (76) of the monkey (36) when viewed in peripheral direction.

11. The diesel type pile-driver of claim 1 characterized in that thee packing collar (50) at the same time delimits a lubrication duct (56).

12. The diesel type pile-driver of claim 11 characterized in that the lubrication duct (56) is a radially open groove cut into a top end of the peripheral surface of the packing collar (50) which communicates with a delivery bore (58) terminating in the top annular face of the packing collar (50).

13. The diesel type pile-driver of claim 12 characterized by a lubricant feed pipe (60) which runs axially away from the delivery bore (58) and passes through recesses (80) in the stop plate (64) and optionally also in annular damping plates (66, 68).

14. The deisel type pile-driver of claim 1 characterized in that the outside of the peripheral wall (44) of the cup-shaped monkey (36) is provided with cooling fins (74).

15. The diesel type pile-driver of claim 1 characterized in that the cup-shaped monkey (36) has a floor (42) that exhibits a lower central projection (38) which engages in the bottom, open end of the cylinder (10) leaving radial clearance.

16. A diesel type pile driver comprising (a) a diesel combustion cylinder (10) with an open lower end and lower outer walls, (b) a ram (12) slidably mounted within the interior of said diesel combustion cylinder, said ram having a lower surface, (c) a monkey (36) which is in slidable engagement with said open lower end of said diesel combustion cylinder (10) so as to seal off said open lower end, said monkey having an upper surface, (d) a working area in which diesel combustion can take place defined between the lower surface of said ram (12) and the upper surface of said monkey (36), (e) passageways opening into said working area to supply fresh air and fuel and for removing diesel combustion gases, (f) said monkey (36) being cup-shaped with upstanding cylindrical side walls (44) and mounted so that its cylindrical side walls are in gas tight sliding engagement with the lower outer walls of said diesel combustion cylinder (10) that are adjacent the open lower end of said diesel combustion cylinder (10), and (g) a plurality of guide brackets (76) extending upwardly from said cylindrical side walls (44) of the monkey (36), said guide brackets (76) being disposed parallel to the axis of said diesel combustion cylinder (10) and slidably engaging the outside of said cylinder (10).

17. The diesel type pile-driver of claim 16 wherein said guide brackets (76) move with a sliding fit in guide collars (70) located on the outer face of said diesel combustion cylinder (10).

18. The diesel type pile-driver of claim 17 wherein the guide brackets have base sections and at these base sections the monkey (36) is provided with an annular, radially inwards projecting stop plate (64), which is able to abut at a lower face of the guide collar (70) and at an upper face of a packing collar (50).

19. The diesel type pile-driver of claim 18 wherein annular damping plates (66, 68) are mounted above the end faces of the top plate 64).

20. The diesel type pile-driver of claim 18 wherein the stop plate (64) and optionally also the annular damping plates (66, 68), are divided along at least one plane passing through the cylinder axis and are detachably fixed (62) at the top end of the peripheral wall (44) of the monkey (36).

21. The diesel type pile-driver of claim 16 wherein at least two essentially radially longitudinally running guide means (82, 84) are provided which cooperate with associated non-equivalent lateral faces (86, 88) of the guide brackets (76) in order to protect the monkey (36) from being swivelled on the cylinder (10) in both directions.

* * * * *